US009027597B2

(12) United States Patent
Kubo

(10) Patent No.: US 9,027,597 B2
(45) Date of Patent: May 12, 2015

(54) OPERATING DEVICE

(75) Inventor: Nobuyasu Kubo, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 288 days.

(21) Appl. No.: 13/578,011

(22) PCT Filed: Feb. 21, 2011

(86) PCT No.: PCT/JP2011/000943
§ 371 (c)(1),
(2), (4) Date: Aug. 9, 2012

(87) PCT Pub. No.: WO2011/105037
PCT Pub. Date: Sep. 1, 2011

(65) Prior Publication Data

US 2012/0305821 A1 Dec. 6, 2012

(30) Foreign Application Priority Data

Feb. 26, 2010 (JP) ..... 2010-041780

(51) Int. Cl.
*F16K 11/065* (2006.01)
*E02F 9/20* (2006.01)
*F15B 13/042* (2006.01)
*G05G 5/03* (2008.04)

(52) U.S. Cl.
CPC ..... *E02F 9/2004* (2013.01); *F15B 13/0422* (2013.01); *G05G 5/03* (2013.01)

(58) Field of Classification Search
CPC .... E02F 9/2004; F15B 13/04; F15B 13/0422; F16K 11/0655; G05G 5/03
USPC ..... 137/625.25, 625.69, 636.1; 251/54
See application file for complete search history.

(56) References Cited

U.S. PATENT DOCUMENTS 3,081,919 A 3/1963 Samuel
3,727,947 A * 4/1973 Small ..... 267/64.16
(Continued)

FOREIGN PATENT DOCUMENTS

DE 1 262 089 2/1968
DE 199 04 169 A1 10/1999
(Continued)

OTHER PUBLICATIONS

Extended European Search Report issued in European Application No. 11747009.6 completed May 27, 2014.
(Continued)

*Primary Examiner* — Craig Schneider
*Assistant Examiner* — Kevin Barss
(74) *Attorney, Agent, or Firm* — Oliff PLC

(57) ABSTRACT

An operating device includes: an operating portion provided in a casing so as to be swingable; hydraulic pilot valves and configured to operate by causing the operating portion to swing; and damper portions configured to generate resistance force with respect to a swing operation of the operating portion when the operating portion is caused to swing. Each of the damper portions is configured to generate friction torque in such a manner that a plurality of swing friction plates configured to swing in accordance with the operating portion is pressed by a pressing spring in a direction perpendicular to a swing direction of the operating portion against a plurality of fixed friction plates configured to be prevented from swinging.

5 Claims, 12 Drawing Sheets

(56) References Cited

U.S. PATENT DOCUMENTS

| | | | | | |
|---|---|---|---|---|---|
| 4,341,243 | A | * | 7/1982 | Melocik | 137/625.68 |
| 4,815,574 | A | * | 3/1989 | Taylor et al. | 188/280 |
| 4,926,905 | A | * | 5/1990 | Helfenstein | 137/625.6 |
| 5,251,660 | A | * | 10/1993 | Hori et al. | 137/636.1 |
| 5,454,400 | A | * | 10/1995 | Rodgers | 137/596.18 |
| 5,558,127 | A | * | 9/1996 | Maruyama et al. | 137/636.1 |
| 5,566,716 | A | * | 10/1996 | Togashi et al. | 137/636.1 |
| 6,125,886 | A | * | 10/2000 | Sagawa et al. | 137/625.69 |
| 6,328,127 | B1 | * | 12/2001 | Hori et al. | 180/333 |
| 6,789,412 | B2 | * | 9/2004 | Mototani et al. | 73/114.57 |
| 7,467,644 | B2 | * | 12/2008 | Blanco | 137/636.1 |
| 2003/0084782 | A1 | | 5/2003 | Kaneda et al. | |

FOREIGN PATENT DOCUMENTS

| | | | |
|---|---|---|---|
| EP | 0 331 177 | A1 | 9/1989 |
| JP | A-61-294281 | | 12/1986 |
| JP | A-6-102950 | | 4/1994 |
| JP | A-7-295669 | | 11/1995 |
| JP | A-11-305863 | | 11/1999 |
| JP | A-2001-124010 | | 5/2001 |
| JP | A-2002-193100 | | 7/2002 |
| JP | A-2002-366242 | | 12/2002 |

OTHER PUBLICATIONS

International Search Report issued in International Patent Application No. PCT/JP2011/000943 dated Apr. 26, 2011.

* cited by examiner

OPERATING DEVICE

TECHNICAL FIELD

The present invention relates to an operating device including a damper portion configured to prevent oscillations and vibrations of an operating portion, the oscillations and vibrations being not intended by an operator, and particularly to the operating device used in construction machinery and the like and configured to remote-control various actuators by tilting the operating portion, such as a lever or a pedal.

BACKGROUND ART

Generally, an operator gets in construction machinery, such as a hydraulic excavator or crane, and remote-controls various actuators by a pilot-type hydraulic operated valve (pilot valve) to perform various operations. Various actuators and operating machines included in the construction machinery are large in size and heavy in weight. If the operator drastically operates the actuators and operating machines, the actuators and operating machines move in a big way. This may cause, for example, large oscillations and vibrations of a carbody, and the actuators and operating machines may not be able to perform normal operations. In addition, the oscillations and vibrations of the carbody when, for example, the construction machinery is running or operating cause the oscillations and vibrations of the operating portion via hands or feet of the operator or by the inertial force of the operating portion itself.

If the oscillations and vibrations which are not intended by the operator are applied to the operating portion as above, the hydraulic operated valve is operated by the oscillations and vibrations, and the hydraulic operated valve causes the actuators to perform operations which are not intended by the operator. As a result, the oscillations and vibrations of the construction machinery may be increased. Then, the increased oscillations and vibrations of the construction machinery may increase the oscillations and vibrations of the operating portion, that is, a vicious cycle may be caused.

Therefore, for example, in both cases where the operator tilts the operating portion of the hydraulic operated valve from a neutral position and the operator returns the operating portion from the tilted position to the neutral position, it is necessary to reduce as much as possible the oscillations and vibrations of the operating portion, the oscillations and vibrations being caused by the oscillations and vibrations of the construction machinery. Therefore, operating devices including damper portions have been proposed.

FIG. 12 is a cross-sectional view showing one example of a conventional operating device (see PTL 1, for example). According to an operating device 100, when the operator operates the operating portion, such as a pedal or a lever, to tilt a tilt member 101 in a tilt direction A1, a push rod 102 is pressed downward to move downward. When the push rod 102 moves downward, a spool 107 is pressed downward via a pressing spring 106 to move downward. At this time, when an oil passage 107*a* extending in a direction perpendicular to an axis communicates with a pump port 108*p* located lower than a tank port 108*t*, the tank port 108*t* is closed by the spool 107, and the pump port 108*p* and an output port 108*o* communicate with each other. With this, the actuator of the construction machinery can be moved in a predetermined direction.

At this time, operating oil in a damper chamber 104 moves from a lower chamber 104*b* to an upper chamber 104*a* through a restrictor 105*a* of a damper portion 105. Therefore, a damping effect (resistance force) with respect to the operation of the operating portion (tilt member 101) can be obtained. On this account, even if the oscillations and vibrations which are not intended by the operator occur on the construction machinery, in which the operator has gotten, when the operator has operated the operating portion, the operation mistake of the operating portion by the operator due to the oscillations and vibrations can be suppressed by the resistance force, and the increase in the oscillations and vibrations of the construction machinery can be reduced.

CITATION LIST

Patent Literature

PTL 1: Japanese Laid-Open Patent Application Publication No. 61-294281

SUMMARY OF INVENTION

Technical Problem

However, in the conventional operating device 100 shown in FIG. 12, the problem is that the damper portion 105 produces the damping effect (resistance force) with respect to the operation of the operating portion (tilt member 101) when the operator has operated the operating portion and the operation speed (swing speed) of the operating portion is equal to or higher than a predetermined speed, but the damper portion 105 does not effectively produce the damping effect when the operation speed of the operating portion is 0, close to 0, or lower than the predetermined speed.

When the damping effect is not effectively produced with respect to the operation of the operating portion since the operation speed of the operating portion is lower than the predetermined speed as above, the operator may give the oscillations and vibrations to the operating portion due to the oscillations and vibrations of, for example, the construction machinery as described above. As a result, the oscillations and vibrations of the construction machinery may be increased.

The reason why the damping effect is not effectively produced when the operation speed of the operating portion is lower than the predetermined speed is because when the operation speed of the operating portion is lower than the predetermined speed, the flow velocity when the operating oil in the damper chamber 104 flows through the restrictor 105*a* of the damper portion 105 is low, and the pressure difference between before and after the restrictor 105*a* is extremely small.

The present invention was made to solve the above problems, and an object of the present invention is to provide an operating device capable of, even when the operation speed of the operating portion is any operation speed, such as 0 (zero), effectively producing the resistance force with respect to the operation of the operating portion and preventing the oscillations and vibrations of the operating portion, the oscillations and vibrations being not intended by the operator.

Solution to Problem

The operating device according to the present invention includes: an operating portion provided at a fixed portion so as to be swingable; and a damper portion configured to, when the operating portion is caused to swing, generate resistance force with respect to a swing operation of the operating portion, wherein: the damper portion is provided with a movable member configured to be movable in such a direction as to increase or decrease volume of a damper chamber; and working pressure generated in the damper chamber when force from the operating portion is applied to the movable member opens a relief valve provided to communicate with the damper chamber, and the working pressure generates damper torque.

According to the operating device of the present invention, when the operator starts causing the operating portion to swing or when the operator is causing the operating portion to swing, the damper portion can generate the resistance force.

According to the damper portion, when the movable member is about to move or moves in accordance with the swing operation of the operating portion, the volume of the damper chamber is about to decrease or decreases. Then, the damper torque can be generated by the working pressure in the damper chamber, the working pressure being generated when the volume of the damper chamber is about to decrease or decreases. When the working pressure reaches set pressure of the relief valve, the valve body of the relief valve provided to communicate with the damper chamber opens, and a force necessary to open the relief valve is generated as the damper torque.

Therefore, even when the operation speed (swing speed) of the operating portion is any operation speed, such as 0 (zero), the damper portion can effectively generate the resistance force with respect to the operation of the operating portion and prevent the oscillations and vibrations of the operating portion, the oscillations and vibrations being not intended by the operator.

The increase in the torque of the damper portion can be easily realized by adjusting the set pressure of the relief valve.

In the operating device according to the present invention, the relief valve may be configured to generate desired damper torque by setting the relief valve such that the relief valve has a desired override characteristic.

The damper portion can generate the desired damper torque by setting the relief valve of the damper portion such that the relief valve has a desired override characteristic. Examples of a method of setting the relief valve such that the relief valve has the desired override characteristic are to change the shape of the valve body of the relief valve and to change the spring constant of the pressing spring configured to press the valve body against the valve seat.

In the operating device according to the present invention, a restrictor may be formed on a passage of the relief valve, the passage being formed such that a pressure liquid flows therethrough when the relief valve is opened.

With this, the damper portion can generate the damper torque corresponding to the operation speed of the operating portion. Therefore, even if a drastic operation force is applied to the operating portion, the operation speed of the operating portion can be reduced.

The operating device according to the present invention further includes a biasing unit configured to bias the operating portion such that the operating portion returns to a predetermined neutral position set at a position within a swing range of the operating portion, wherein damper torque generated by the damper portion when an operation speed of the operating portion is 0 is 30% or higher of a neutral return torque generated by the biasing unit when the operating portion is at the neutral position and is lower than the neutral return torque.

With this, the oscillations and vibrations of the operating portion in, for example, the front or rear direction from the neutral position can be effectively prevented, the oscillations and vibrations being not intended by the operator. As described above, the damper torque generated by the damper portion when the operation speed of the operating portion is 0 is set to be 30% or higher of the neutral return torque generated by the biasing unit when the operating portion is at the neutral position. Therefore, even when the operating portion is moved to any operation position, the oscillations and vibrations of the operating portion can be effectively prevented. In addition, as described above, the damper torque generated by the damper portion when the operation speed of the operating portion is 0 is set to be lower than the neutral return torque. Therefore, even when the operating portion is moved to any operation position, the operating portion can automatically return to the neutral position when the hands of the operator are released from the operating portion.

The operating device according to the present invention further includes a hydraulic pilot valve configured to operate by causing the operating portion to swing, wherein: the pilot valve includes a casing having a pump port, a tank port, and an output port, a spool provided in the casing and configured to switch the output port between the pump port and the tank port, and a pusher configured to be caused to slide relative to the spool; and by pressing the pusher by the operating portion to cause the spool to slide, liquid pressure from the pump port is supplied to the output port.

According to the operating device, the pusher can be pressed by causing the operating portion to swing by the operator. The pressed pusher can cause the spool to slide to supply the liquid pressure from the pump port to the output port. Then, the liquid pressure supplied to the output port can cause, for example, an actuator or operating machine connected to the output port to operate. Moreover, when the operator starts causing the operating portion to swing or when the operator is causing the operating portion to swing, the damper portion can generate the resistance force.

Advantageous Effects of Invention

According to the operating device of the present invention, even when the operation speed (swing speed) of the operating portion is any operation speed, such as 0 (zero), the operating device can effectively generate the resistance force with respect to the operation of the operating portion. Therefore, even when the operation speed of the operating portion is any operation speed, such as 0, it is possible to effectively prevent the oscillations and vibrations from being applied to the operating portion by the operator due to the oscillations and vibrations of, for example, the construction machinery. As a result, the increase in the oscillations and vibrations of the construction machinery can be prevented.

BRIEF DESCRIPTION OF DRAWINGS

FIG. 1A is a vertical cross-sectional side view including a hydraulic circuit, and FIG. 1B is a vertical cross-sectional front view.

FIG. 4A is a vertical cross-sectional side view, and FIG. 4B is a vertical cross-sectional front view.

FIG. 6A is a vertical cross-sectional side view, and FIG. 6B is a vertical cross-sectional front view.

FIG. 8A is a vertical cross-sectional side view, and FIG. 8B is a vertical cross-sectional front view.

FIG. 10A is a vertical cross-sectional side view, and FIG. 10B is a vertical cross-sectional front view.

DESCRIPTION OF EMBODIMENTS

Hereinafter, Reference Technical Example 1 related to an operating device according to the present invention will be explained in reference to FIGS. 1 to 3. An operating device 50 shown in FIGS. 1A and 1B can independently drive left and right crawlers of construction machinery, such as a hydraulic excavator, and includes a left operating device 51 configured to operate the left crawler and a right operating device 52 configured to operate the right crawler.

Figure 1B:
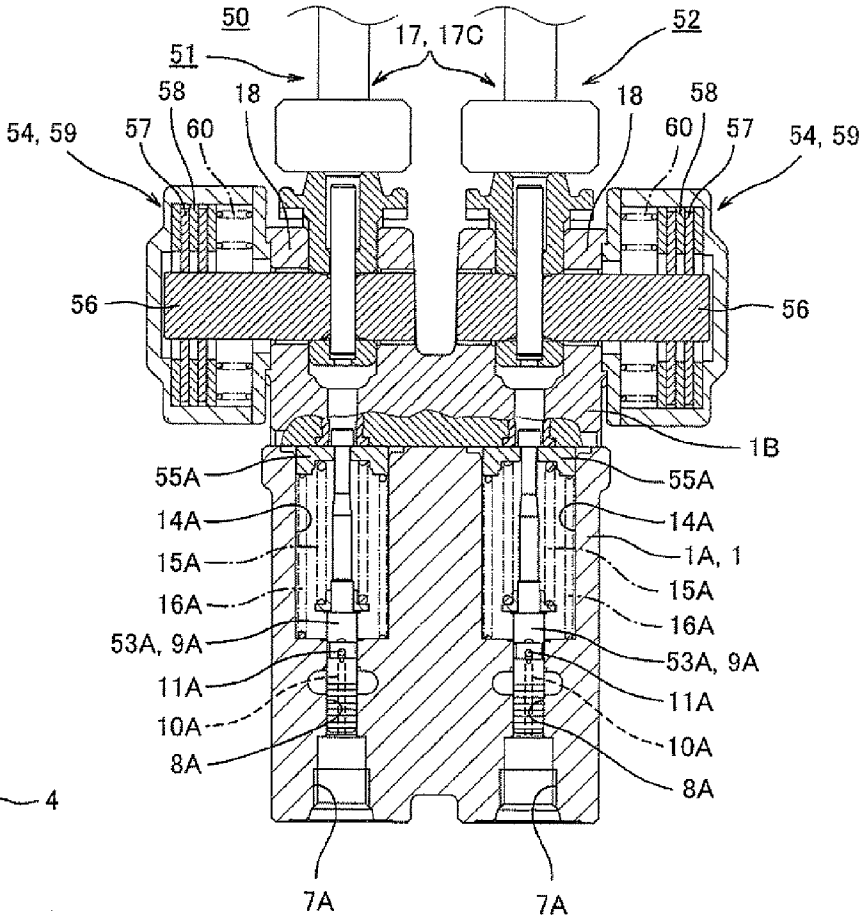
FIGS. 1A and 1B are diagrams each showing an operating device according to Reference Technical Example 1 related to the present invention.
Figure 1A:
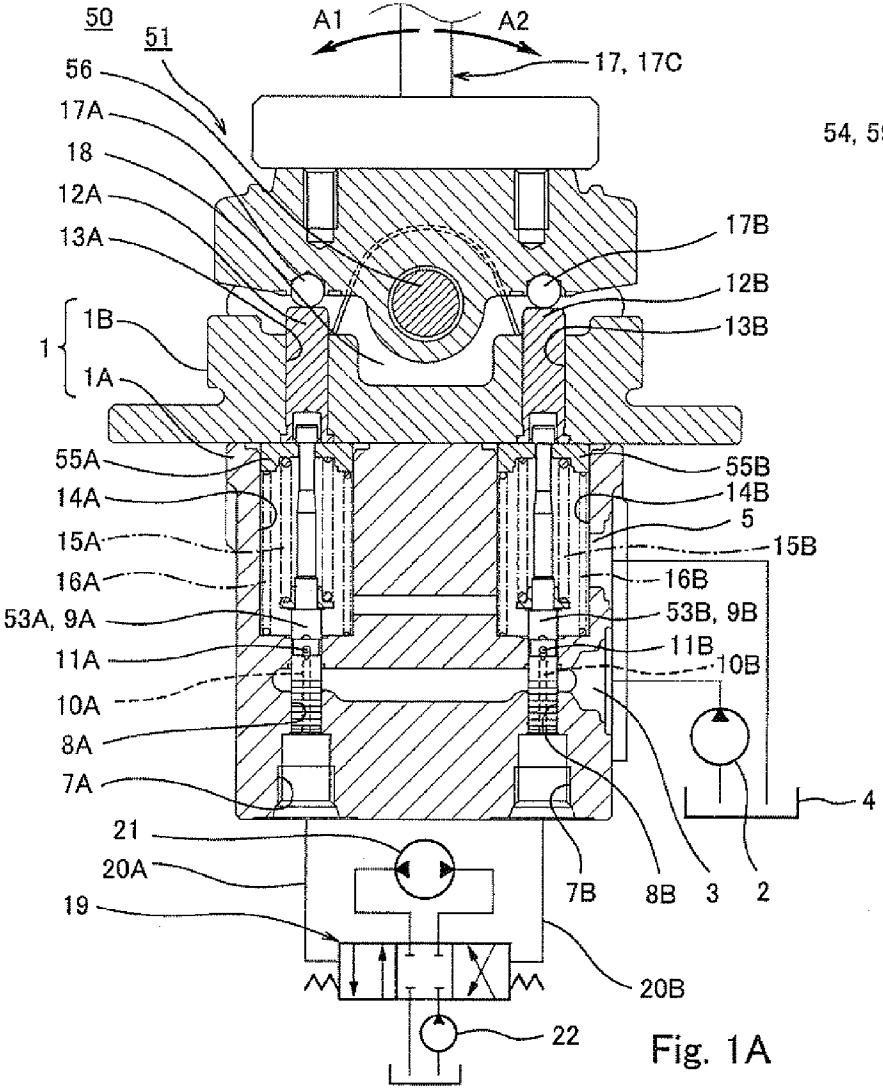

When an operator causes a left operating portion 17 of the left operating device 51 shown in FIG. 1A to swing in a direction A1 (rear direction), a hydraulic first pilot valve 53A can be operated to drive the left crawler in a backward direction. When the operator causes the left operating portion 17 to swing in a direction A2 (front direction), a hydraulic second pilot valve 53B can be operated to drive the left crawler in a forward direction.

Similarly, when the operator causes a right operating portion 17 (right operating device 52) shown in FIG. 1B to swing in the front or rear direction, a hydraulic third or fourth pilot valve 53A or 53B can be operated to drive the right crawler in the backward or forward direction.

The left operating device 51 and the right operating device 52 are the same as each other. Therefore, the same reference signs are used for the same components, and the left operating device 51 will be explained and an explanation of the right operating device 52 is omitted.

As shown in FIGS. 1A and 1B, the left operating device 51 includes the left operating portion 17, the first pilot valve 53A, the second pilot valve 53B, and a left damper portion 54. The left damper portion 54 generates resistance force when the left operating portion 17 is caused to swing.

As shown in FIG. 1A, the left operating device 51 is provided in a casing 1, and the casing 1 includes a lower easing 1A and an upper casing 1B.

The casing 1 includes a pump port 3 into which hydraulic oil from a hydraulic pump 2 flows and a tank port 5 which communicates with a tank 4 at all times. Further, the casing 1 includes output ports 7A and 7B. Moreover, the casing 1 includes passages 8A and 8B communicating with the pump port 3, the tank port 5, and the output ports 7A and 7B. Spools 9A and 9B are respectively attached to the passages 8A and 8B so as to be slidable. The spool 9A constitutes the first pilot valve 53A, and the spool 9B constitutes the second pilot valve 53B.

The spool 9A includes an oil passage 10A extending in a shaft center direction of the spool 9A and an oil hole 11A extending in a direction perpendicular to the shaft center of the spool 9A, and the spool 9B includes an oil passage 10B extending in a shaft center direction of the spool 9B and an oil hole 11B extending in a direction perpendicular to the shaft center of the spool 9B. The oil passage 10A and the oil hole 11A communicate with each other, and the oil passage 10B and the oil hole 11B communicate with each other.

As shown in FIGS. 1A and 1B, the output port 7A is configured to selectively communicate with the tank port 5 or the pump port 3 through the oil passage 10A, the oil hole 11A, and the passage 8A, and the output port 7B is configured to selectively communicate with the tank port 5 or the pump port 3 through the oil passage 10B, the oil hole 11B, and the passage 8B.

The casing 1 includes insertion holes 13A and 13B, and pushers 12A and 12B are respectively inserted in the insertion holes 13A and 13B so as to be slidable. The pushers 12A and 12B respectively cause the spools 9A and 9B to slide. Upper end portions of the pushers 12A and 12B project to the outside of the casing 1, and lower end portions thereof respectively face spring chambers 14A and 14B which communicate with the tank port 5 of the casing 1 at all times.

Balance springs 15A and 15B are respectively provided in the spring chambers 14A and 14B. The balance spring 15A is provided between the pusher 12A and the spool 9A, and the balance spring 15B is provided between the pusher 12B and the spool 9B. A spring holding portion 55A is provided between the lower end portion of the pusher 12A and an upper end portion of the balance spring 15A, and a spring holding portion 55B is provided between the lower end portion of the pusher 12B and an upper end portion of the balance spring 15B. Further, a return spring 16A is provided between the spring holding portion 55A and a bottom surface of the spring chamber 14A, and a return spring 16B is provided between the spring holding portion 55B and a bottom surface of the spring chamber 14B.

As shown in FIG. 1A, the operating portion 17 having a substantially inverted T shape is provided at an upper portion of the cylinder 1. The operating portion 17 is provided at a bracket 18 (fixed portion) so as to be swingable via a rocker shaft 56, the bracket 18 being provided at the upper portion of the casing 1. The operating portion 17 includes a pair of left and right pressing portions 17A and 17B provided at a lower portion thereof and a lever portion 17C.

Herein, the operating portion 17 includes the lever portion 17C. However, the operating portion 17 may include a pedal portion (not shown) instead of the lever portion 17C or may include both the lever portion and the pedal portion.

The pair of pressing portion 17A and 17B respectively press the pushers 12A and 12B. The lever portion 17C is formed to project upward from an intermediate position between the pressing portions 17A and 17B and is operated by the operator.

As shown in FIG. 1A, a direction switching valve 19 is connected to the left operating device 51. Two pilot chambers of the direction switching valve 19 are respectively connected to the output ports 7A and 7B via pipes 20A and 20B. Actuators, such as a hydraulic motor 21, and a main pump 22 configured to drive the hydraulic motor 21 are connected to the direction switching valve 19.

Next, the left damper portion 54 that is one feature of the present invention will be explained in reference to FIGS. 1 to 3. As shown in FIG. 1B, the left operating device 51 and the right operating device 52 included in the operating device 50 are respectively provided with the left damper portion 54 and a right damper portion 54. The left damper portion 54 and the right damper portion 54 are the same as each other. Therefore, the same reference signs are used for the same components, and the left damper portion 54 will be explained and an explanation of the right damper portion 54 is omitted.

When the operator causes the operating portion 17 to swing in the direction A1 or A2 shown in FIG. 1A, the left damper portion 54 shown in FIG. 1B can generate the resistance force with respect to the swing operation of the operating portion 17. The resistance force is generated by friction torque acting among a plurality of swing friction plates 57 and a plurality of fixed friction plates 58 which are pressed to contact one another. FIG. 2 is an enlarged cross-sectional view schematically showing the left damper portion 54.

Figure 2:
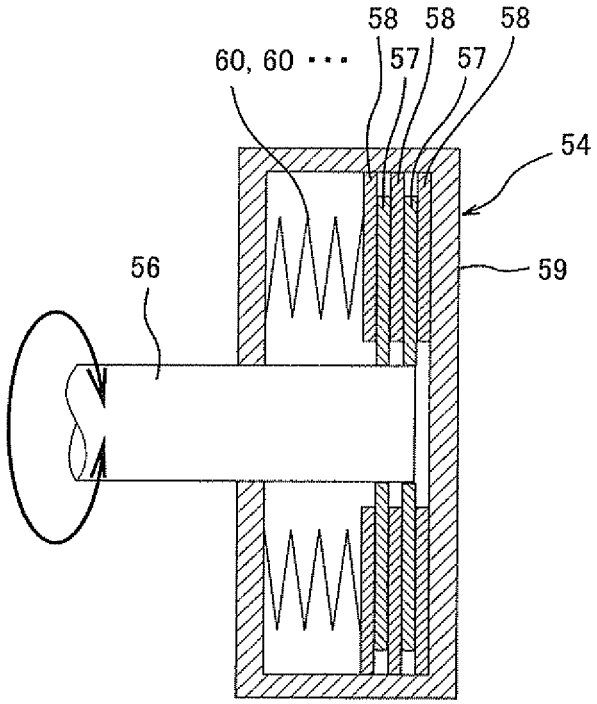
FIG. 2 is an enlarged cross-sectional view showing a damper portion included in the operating device according to Reference Technical Example 1 related to the present invention.
Figure 3:
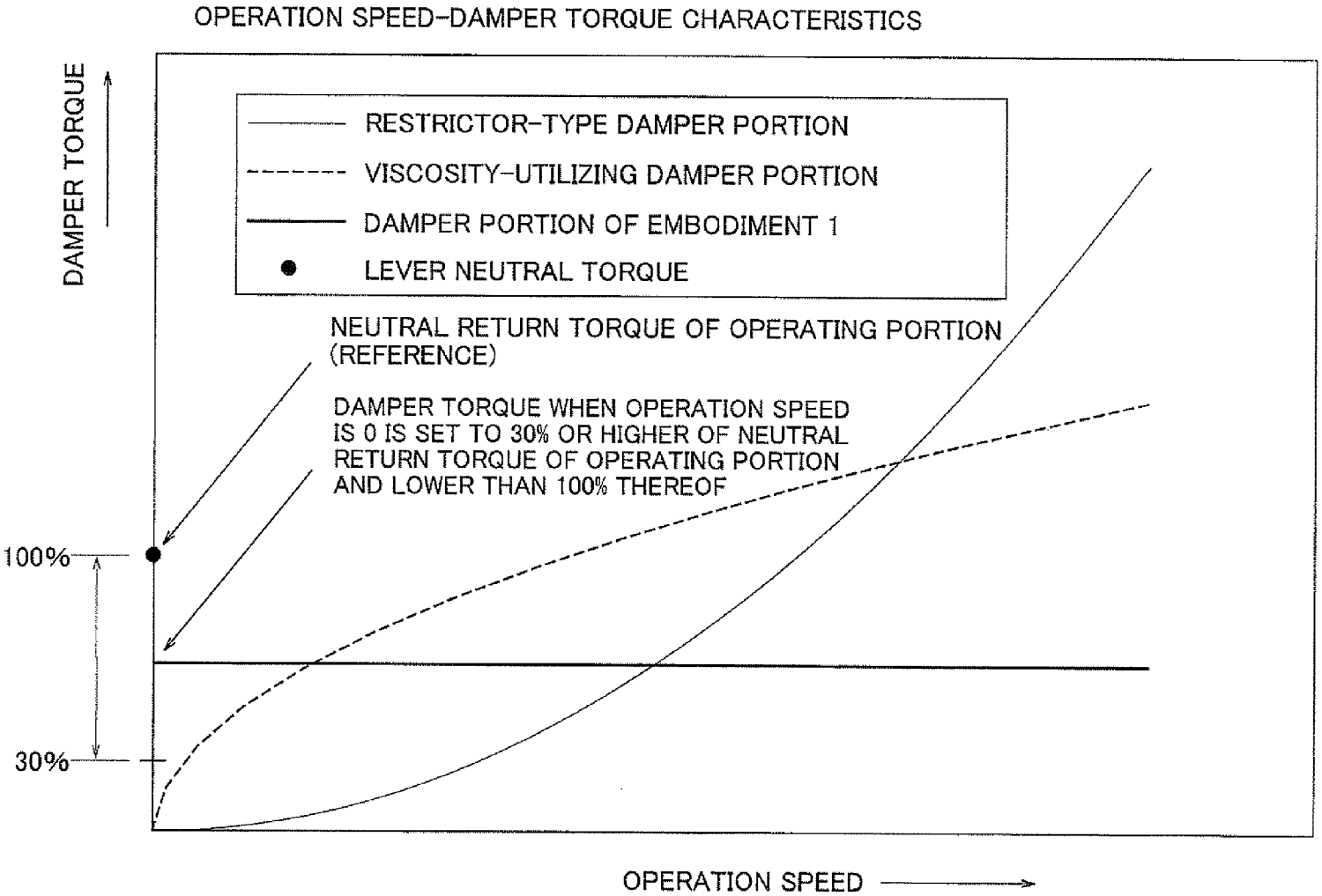
FIG. 3 is a characteristic diagram showing a relation between a damper torque and an operation speed of an operating portion of the operating device according to Reference Technical Example 1 related to the present invention.

As shown in FIGS. 1B and 2, the left damper portion 54 includes the plurality of swing friction plates 57 and the plurality of fixed friction plates 58. The plurality of swing friction plates 57 and the plurality of fixed friction plates 58 are provided in a damper case 59 so as to alternately overlap one another and are attached to the rocker shaft 56 so as to be movable relative to the rocker shaft 56 in an axial direction of the rocker shaft 56.

Each of the plurality of swing friction plates 57 is a circular plate. A through hole is formed at the center of the plate 57, and the rocker shaft 56 is inserted through the through holes. The plurality of swing friction plates 57 are attached to the rocker shaft 56 so as not to be rotatable relative to the rocker shaft 56 and are formed so as to swing in accordance with the rocker shaft 56. To be specific, for example, the rocker shaft 56 is formed as a spline shaft, and convex portions respectively formed on inner peripheral edge portions of the through holes of the swing friction plates 57 respectively fit in grooves of the spline shaft.

Each of the plurality of fixed friction plates 58 is, for example, an oval plate. A through hole is formed at the center of the plate 58, and the rocker shaft 56 is inserted through the through holes. The plurality of fixed friction plates 58 are not rotatable relative to the damper case 59 and do not contact the rocker shaft 56. To be specific, for example, the damper case 59 is formed in an oval tubular shape, and the plurality of fixed friction plates 58 each formed as the oval plate are fixed so as not to swing about the rocker shaft 56.

The damper case 59 is fixedly provided at the casing 1, and, for example, a plurality of pressing springs 60 are provided in the damper case 59. The plurality of pressing springs 60 press the plurality of swing friction plates 57 and the plurality of fixed friction plates 58 in the axial direction of the rocker shaft 56 to cause these friction plates to strongly contact one another. With this, the friction torque is generated with respect to the operation of the operating portion 17.

Next, the operations and actions of the left operating device 51 configured as above will be explained. Since the right operating device 52 operates and acts in the same manner as the left operating device 51, an explanation thereof is omitted.

First, when the operating portion 17 is not caused to swing, that is, when the operating portion 17 is at the neutral position as shown in FIG. 1A, the upper end portions of the pushers 12A and 12B project upward from the casing 1 by the spring force of the balance springs 15A and 15B and the return springs 16A and 16B to respectively contact the pressing portions 17A and 17B. In this state, the pushers 12A and 12B are respectively located at the neutral positions. The spools 9A and 9B are also located at the neutral positions, respectively, and the output ports 7A and 7B communicate with the tank port 5 through the oil passages 10A and 10B and the oil holes 11A and 11B in this order, respectively. With this, the pilot chambers of the direction switching valve 19 are the same in pressure as each other, and the direction switching valve 19 is maintained at the neutral position.

Next, when the operator causes the operating portion 17 to swing in the direction A1 shown in FIG. 1A, the pressing portion 17A can press the pusher 12A to cause the pusher 12A to move downward. When the pusher 12A moves downward, the balance spring 15A can cause the spool 9A to slide downward while the balance spring 15A is being compressed. Then, the communication between the oil hole 11A and the tank port 5 is blocked, and the oil hole 11A communicates with the pump port 3. As a result, the hydraulic oil of the hydraulic pump 2 flows through the pump port 3, the oil hole 11A, and the oil passage 10A in this order to be supplied through the output port 7A to one of the pilot chambers of the direction switching valve 19. With this, the direction switching valve 19 is switched, and the hydraulic oil is supplied from the main pump 22 to the hydraulic motor 21.

When the hydraulic oil is supplied from the hydraulic pump 2 through the oil hole 11A and the oil passage 10A to the output port 7A as above, the pressure in the output port 7A becomes high. This high pressure is applied to the spool 9A, and the spool 9A is pressed upward. With this, the communication between the oil hole 11A and the pump port 3 is blocked, and the oil hole 11A communicates with the tank port 5. Thus, the pressure in the oil passage 10A becomes low. Therefore, the spool 9A again slides downward by the spring force of the balance spring 15A, and the pump port 3A and the oil hole 11A communicate with each other.

As above, the balance spring 15A causes the spool 9A to move upward and downward while balancing the spring force and the pressure in the output port 7A. Thus, the balance spring 15A suitably sets the pressure in the output port 7A. To be specific, while the spool 9A repeatedly, finely moves up and down, it reduces the pressure of the hydraulic oil in the pump port 3 and supplies the hydraulic oil to one of the pilot chambers of the direction switching valve 19. Thus, a spool of the direction switching valve 19 can be moved to a switched position, the length of movement of the spool of the direction switching valve 19 corresponding to a pressure difference between the pressure of one of the pilot chambers and the pressure of the other pilot chamber communicating with the tank port 5.

As described above, by causing the operating portion 17 shown in FIG. 1A to swing in the direction A1, the spool 9A of the first pilot valve 53A can be caused to move downward, and the hydraulic oil having desired pressure can be supplied to the output port 7A. At this time, the pressure of the tank port 5 is being applied to the output port 7B.

Thus, the hydraulic motor 21 can be driven in a predetermined direction, and the left crawler can be driven in the backward direction by an output corresponding to a swing angle of the operating portion 17.

As with the case where the operating portion 17 can be operated in the direction A1 to drive the left crawler in the backward direction by the output corresponding to the swing angle of the operating portion 17, the operating portion 17 can be operated in the direction A2 to drive the left crawler in the forward direction by the output corresponding to the swing angle of the operating portion 17, so that its explanation is omitted.

Next, the actions of the left damper portion 54 shown in FIGS. 1B and 2 will be explained. Since the right damper portion 54 acts in the same manner as the left damper portion 54, an explanation thereof is omitted. When the operator starts causing the operating portion 17 to swing or when the operator is causing the operating portion 17 to swing, the left damper portion 54 can generate the resistance force with respect to the swing operation of the operating portion 17. Then, the left damper portion 54 generates the friction torque in such a manner that the swing friction plates 57 configured to swing in accordance with the operating portion 17 are pressed by the pressing springs 60 against the fixed friction plates 58 configured to be prevented from swinging. Therefore, even when the operation speed (swing speed) of the operating portion 17 is any operation speed, such as 0 (zero), the left damper portion 54 can effectively generate the resistance force with respect to the operation of the operating portion 17 and prevent the oscillations and vibrations of the operating portion 17, the oscillations and vibrations being not intended by the operator.

To be specific, even when the operation speed of the operating portion 17 by the operator is any operation speed, such as 0, it is possible to effectively prevent the operator from applying the oscillations and vibrations to the operating portion 17 due to the oscillations and vibrations of, for example, the construction machinery in which the operating device 50 is provided. As a result, the oscillations and vibrations of the construction machinery can be prevented from increasing.

As shown in FIG. 1A, the operating device 50 includes the return springs 16A and 16B (biasing units) configured to bias the operating portion 17 such that the operating portion 17 returns to a predetermined neutral position set at a position within a swing range of the operating portion 17 configured to be swingable. Then, the damper torque generated by the left damper portion 54 when the operation speed of the operating portion 17 is 0 (zero) is set to be 30% or higher of neutral return torque generated by the return springs 16A and 16B when the operating portion 17 is at the neutral position and be lower than the neutral return torque, preferably be 50 to 80%.

With this configuration, the oscillations and vibrations of the operating portion 17 in, for example, the front or rear direction from the neutral position shown in FIG. 1A can be effectively prevented, the oscillations and vibrations being not intended by the operator. As described above, the damper torque generated by the left damper portion 54 when the operation speed of the operating portion 17 is 0 is set to be 30% or higher of the neutral return torque generated by the return springs 16A and 16B when the operating portion 17 is at the neutral position. Therefore, even when the operating portion 17 is moved to any operation position, the oscillations and vibrations of the operating portion 17 can be effectively prevented. In addition, as described above, the damper torque generated by the left damper portion 54 when the operation speed of the operating portion 17 is 0 is set to be lower than the neutral return torque. Therefore, even when the operating portion 17 is moved to any operation position, the operating portion 17 can automatically return to the neutral position when the hands of the operator are released from the operating portion 17.

Further, according to the left damper portion 54 shown in FIGS. 1B and 2, the increase in the friction torque of the left damper portion 54 can be realized by providing a desired number of swing friction plates 57 and fixed friction plates 58 overlapping one another. Even if the friction torque is increased as above, the size of the left damper portion 54 just increases in a direction (direction of the rocker shaft 56) perpendicular to the swing direction of the operating portion 17 and can be prevented from increasing in a radial direction (radial direction of the rocker shaft 56) of the swing operation of the operating portion 17. Thus, it is possible to provide the left operating device 51 including the left damper portion 54 which is small in size.

Next, the relation between the operation speed and the damper torque shown in FIG. 3 will be explained. As shown in FIG. 3, according to the damper portion 54 of Reference Technical Example 1, even when the operation speed (swing speed) of the operating portion 17 is any operation speed, such as 0 (zero), the damper torque (resistance force) with respect to the operation of the operating portion 17 is substantially constant. Therefore, even when the operation speed (swing speed) of the operating portion 17 is 0 (zero), the oscillations and vibrations of the operating portion 17 can be prevented.

Figure 12:
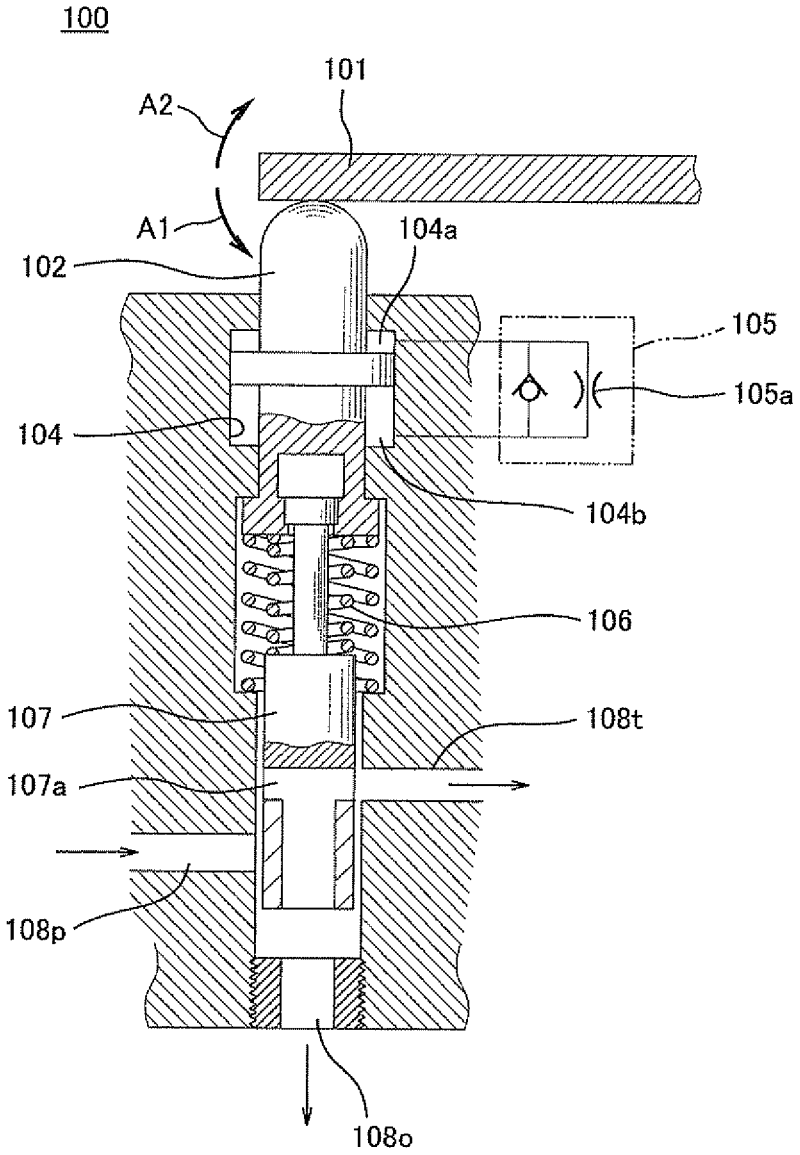
FIG. 12 is a partially enlarged cross-sectional view showing a conventional operating device.

In contrast, according to the restrictor-type damper portion 105 shown in FIG. 12 or a viscosity-utilizing damper portion, not shown, when the operation speed (swing speed) of the operating portion is 0 (zero), the damper torque (resistance force) with respect to the operating portion is 0 (zero). Therefore, at this time, the oscillations and vibrations of the operating portion may occur.

Next, Reference Technical Example 2 related to the operating device according to the present invention will be explained in reference to FIGS. 4 and 5. A difference between an operating device 61 according to Reference Technical Example 2 shown in FIGS. 4 and 5 and the operating device 50 according to Reference Technical Example 1 shown in FIGS. 1 and 2 is that a damper portion 62 capable of generating the resistance force with respect to the swing operation of the operating portion 17 when the operator causes the operating portion 17 to swing in the direction A1 or A2 is different from the damper portion 54. Other than the above, Reference Technical Example 2 is the same as Reference Technical Example 1. Therefore, the same reference signs are used for the same components, and detailed explanations thereof are omitted.

Figure 4B:
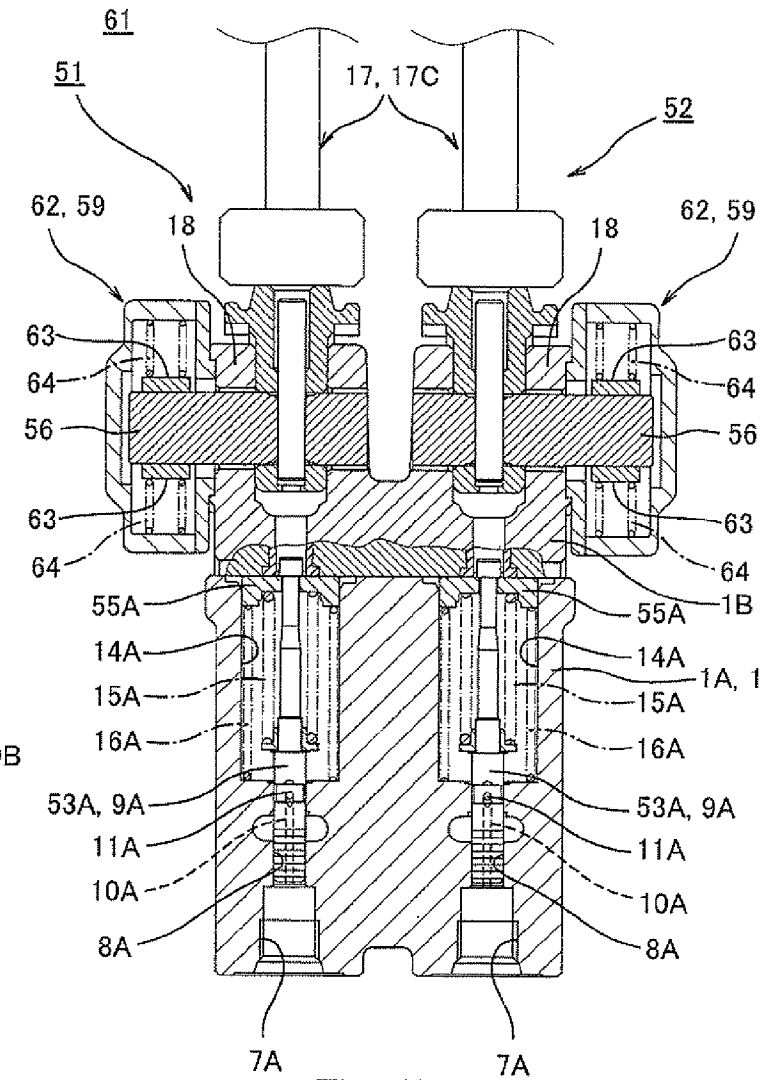
FIGS. 4A and 4B are diagrams each showing the operating device according to Reference Technical Example 2 related to the present invention.
Figure 4A:
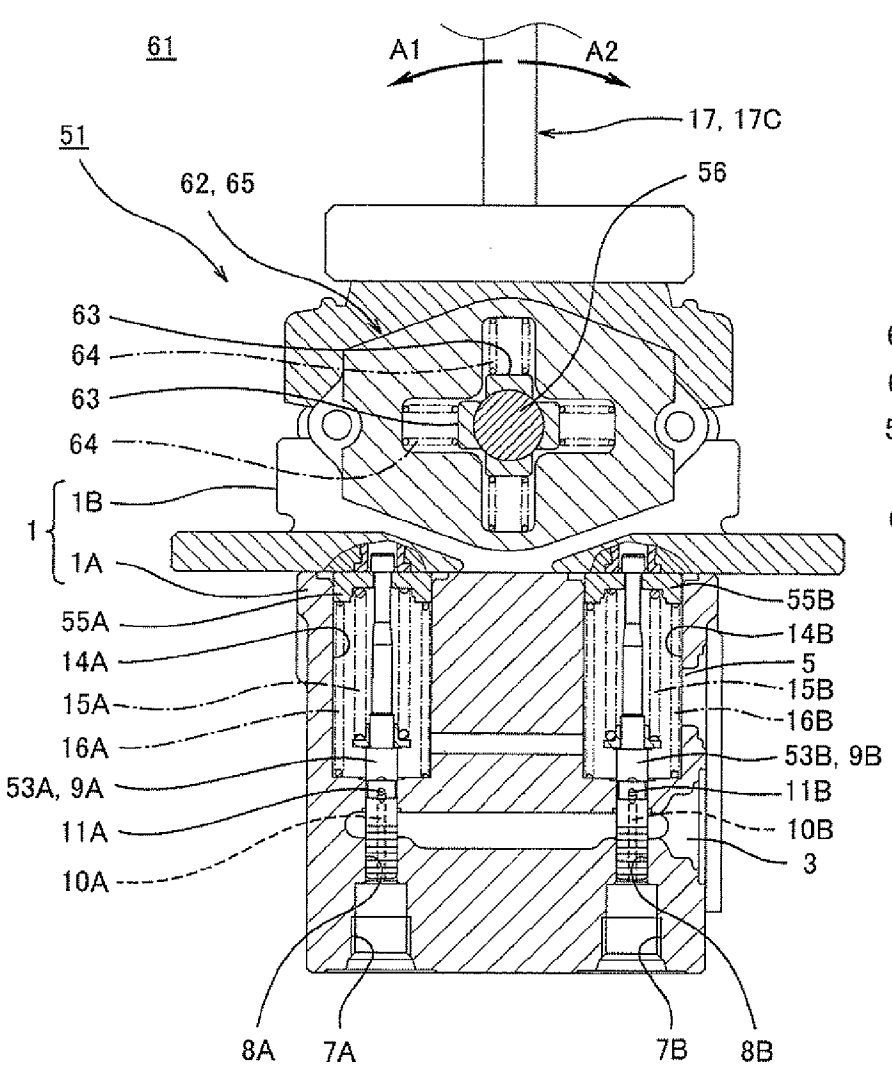

Left and right damper portions 62 shown in FIG. 4B are the same as each other. As shown in FIGS. 5 and 4A, each of the damper portions 62 can generate the friction torque in such a manner that four fixed friction plates 63 configured to be prevented from swinging are respectively pressed by four pressing springs 64 from four directions toward the shaft center of the rocker shaft 56 against the outer surface of the rocker shaft 56 configured to be rotated in accordance with the operating portion 17.

As shown in FIG. 4A, these four fixed friction plates 63 are arranged in a circumferential direction of the rocker shaft 56 at about every 90° so as to contact the outer surface of the rocker shaft 56. The fixed friction plates 63 are respectively pressed by the four pressing springs 64 in a direction toward the shaft center of the rocker shaft 56.

These four sets of the fixed friction plates 63 and the pressing springs 64 are respectively accommodated in four recesses formed on a damper case 65. Inner surfaces of the recesses respectively prevent these four sets of the fixed friction plates 63 and the pressing springs 64 from swinging in accordance with the rocker shaft 56 when the rocker shaft 56 rotates. The damper case 65 is fixedly provided at the casing 1.

In Reference Technical Example 2, as shown in FIG. 4A, four sets of the fixed friction plates 63 and the pressing springs 64 are provided. However, instead of this, three sets or five or more sets of the fixed friction plates 63 and the pressing springs 64 may be provided.

Figure 5:
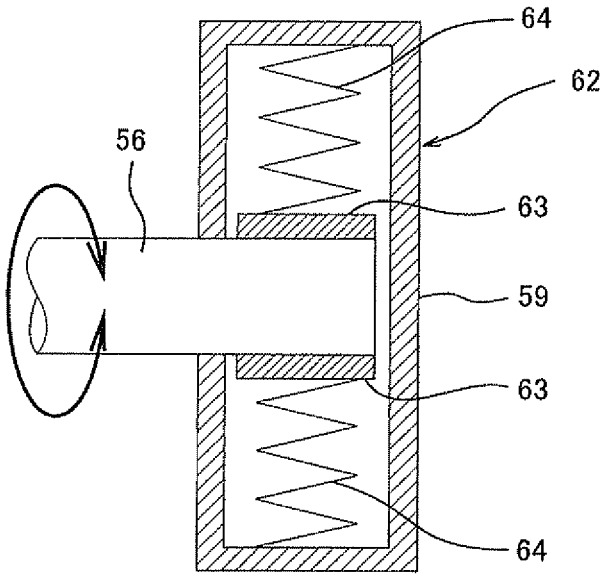
FIG. 5 is an enlarged cross-sectional view showing the damper portion included in the operating device according to Reference Technical Example 2 related to the present invention.

According to the operating device 61 shown in FIGS. 4 and 5, when the operator starts causing the operating portion 17 to swing or when the operator is causing the operating portion 17 to swing, the damper portion 62 can generate the resistance force as with Reference Technical Example 1.

The damper portion 62 generates the friction torque in such a manner that the fixed friction plates 63 configured to be prevented from swinging are respectively pressed by the pressing springs 64 toward the shaft center of the rocker shaft 56 against the outer surface of the rocker shaft 56 configured to be rotated in accordance with the operating portion 17. Therefore, even when the operation speed (swing speed) of the operating portion 17 is any operation speed, such as 0 (zero), the damper portion 62 can effectively generate the resistance force with respect to the operation of the operating portion 17 and prevent the oscillations and vibrations of the operating portion 17, the oscillations and vibrations being not intended by the operator.

The damper portion 62 generates the frictional resistance in such a manner that four fixed friction plates 63 configured to be prevented from swinging are respectively pressed by the pressing springs 64 from four directions toward the shaft center of the rocker shaft 56 against the outer surface of the rocker shaft 56 configured to be rotated. Therefore, although friction surfaces of these four fixed friction plates 63 and the outer surface of the rocker shaft 56 may abrade away due to the long-term use of the damper portion 62, the friction area of the entire friction surface does not decrease. Thus, the decrease in the friction torque generated by the damper portion 62 can be prevented, and the damper portion 62 can generate substantially constant friction torque for a long period of time.

To be specific, the following will consider a case where, for example, a pair of (two or less) semicircular fixed friction plates are pressed against the outer surface of the rocker shaft 56. If the friction surfaces of the pair of fixed friction plates abrade away, the contact pressure between the outer surface of the rocker shaft 56 and each of the friction surfaces of respective end portions of the fixed friction plates may decrease, and the friction torque may decrease.

Next, Embodiment 1 of the operating device according to the present invention will be explained in reference to FIGS. 6 and 7. A difference between an operating device 67 according to Embodiment 1 shown in FIGS. 6 and 7 and the operating device 50 according to Reference Technical Example 1 shown in FIGS. 1 and 2 is that a damper portion 68 capable of generating the resistance force with respect to the swing operation of the operating portion 17 when the operator causes the operating portion 17 to swing in the direction A1 or A2 is different from the damper portion 54. Other than the above, Embodiment 1 is the same as Reference Technical Example 1. Therefore, the same reference signs are used for the same components, and detailed explanations thereof are omitted.

Figure 6B:
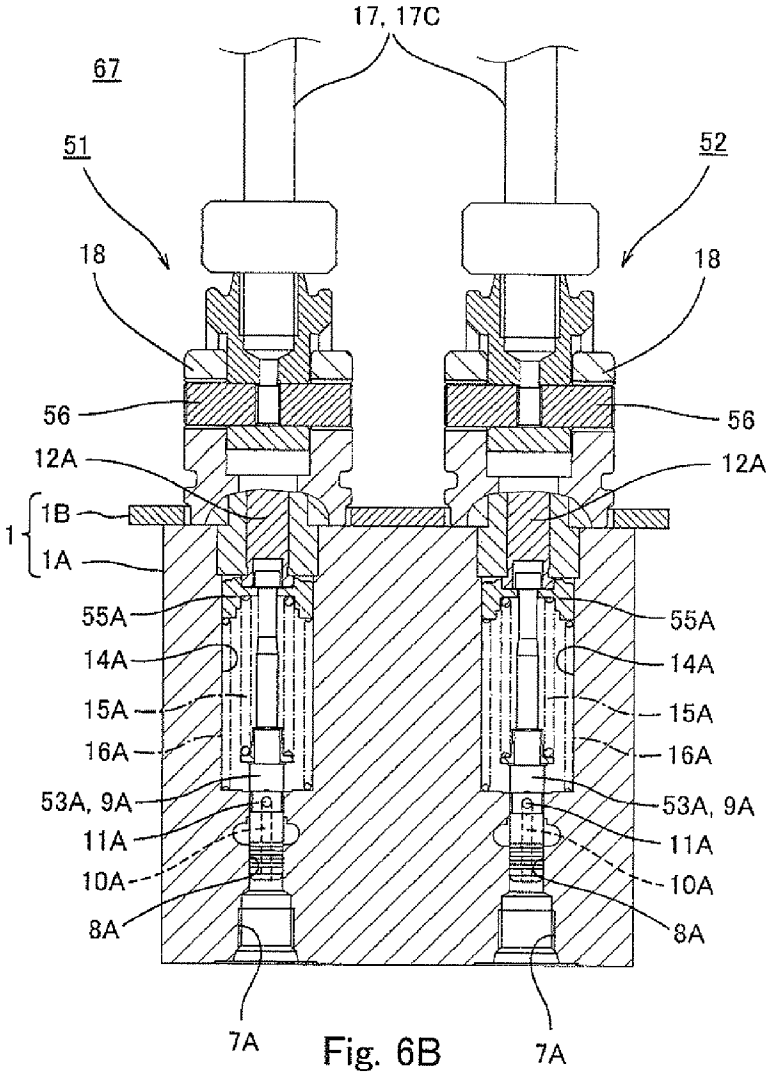
FIGS. 6A and 6B are diagrams each showing the operating device according to Embodiment 1 of the present invention.
Figure 6A:
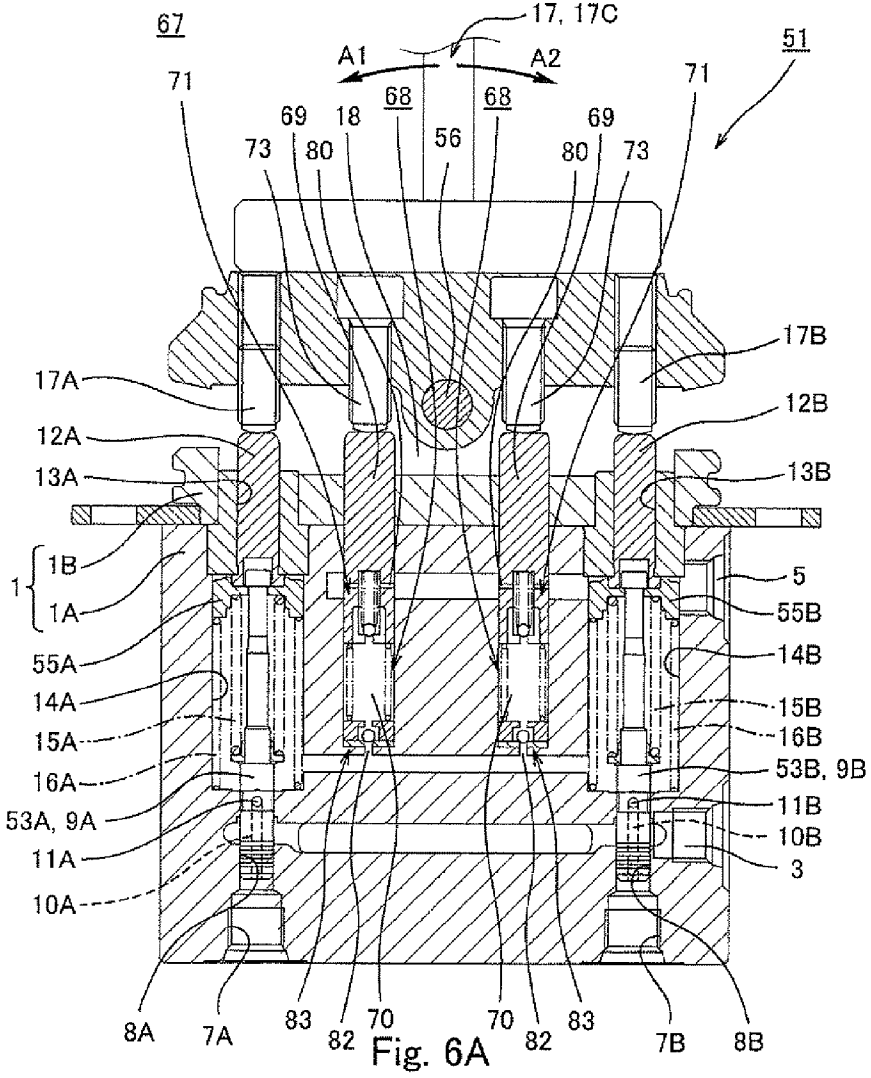

Left and right damper portions 68 shown in FIG. 6A are the same as each other. As shown in FIGS. 7 and 6A, each of the damper portions 68 is provided with a movable member 69 configured to increase or decrease the volume of a damper chamber 70 and be movable in a straight direction. When the movable member 69 moves in the straight direction in accordance with the swing operation of the operating portion 17, the volume of the damper chamber 70 is decreased. By working pressure generated by the decrease in the volume of the damper chamber 70, a relief valve 71 communicating with the damper chamber 70 opens, and this working pressure can generate the damper torque.

As shown in FIG. 6A, the damper chamber 70 is formed in the casing 1, and the movable member 69 is inserted in the damper chambers 70 so as to be slidable in the upper-lower direction. Then, the upper end portion of the movable member 69 projects upward from the casing 1 and contacts a pressing portion 73 provided at the operating portion 17.

A return spring 74 is provided in the damper chamber 70 and biases the movable member 69 so as to push the movable member 69 in an upward direction.

Figure 7:
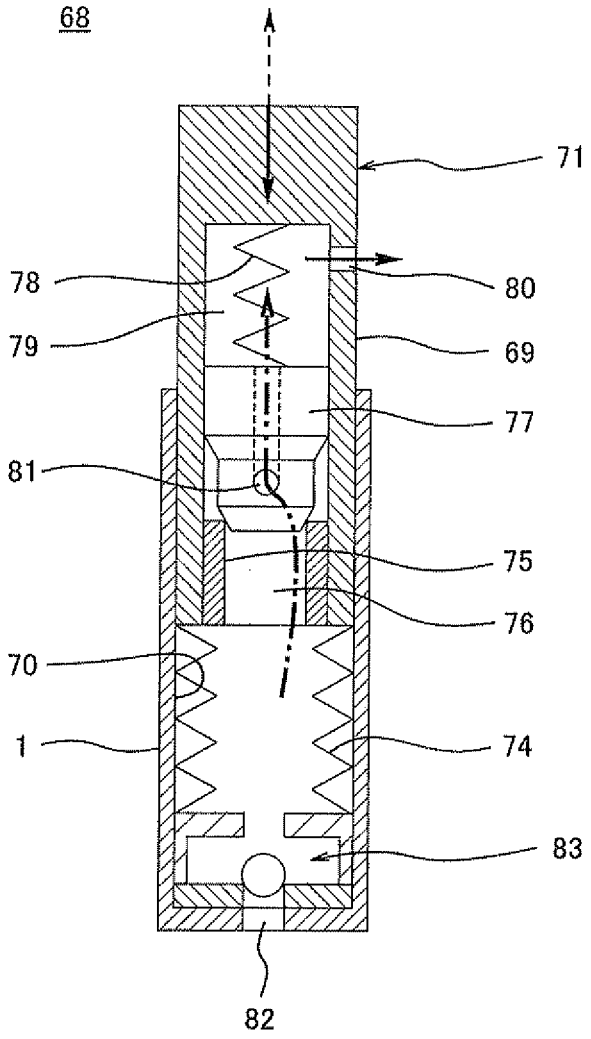
FIG. 7 is an enlarged cross-sectional view showing the damper portion included in the operating device according to Embodiment 1 of the present invention.

As shown in FIG. 7, the relief valve 71 is provided at the movable member 69. In the relief valve 71, a valve body 77 is provided so as to close a valve hole 76 formed at a valve seat 75 and is biased by a relief spring 78 (pressing spring) in a direction toward the valve seat 75. The relief spring 78 is provided in a back pressure chamber 79, and the back pressure chamber 79 communicates with the tank port 5 through an opening 80 formed on the movable member 69 (see FIG. 6A).

An oil passage 81 is formed on the valve body 77 of the relief valve 71 shown in FIG. 7. In an open valve state, the oil passage 81 causes the damper chamber 70 and the back pressure chamber 79 to communicate with each other.

Further, an opening 82 is formed on the bottom of the damper chamber 70, and the damper chamber 70 communicates with the tank port 5 through the opening 82 (see FIG. 6A). A check valve 83 is provided at the opening 82. The check valve 83 can allow the oil on the tank port 5 side to flow into the damper chamber 70 through the opening 82 but is provided to prevent the oil in the damper chamber 70 from flowing out through the opening 82.

According to the operating device 67 shown in FIGS. 6 and 7, when the operator starts causing the operating portion 17 to swing or when the operator is causing the operating portion 17 to swing, the damper portion 68 can generate the resistance force as with Reference Technical Example 1.

According to the damper portion 68, when the movable member 69 is about to move down or moves down in accordance with the swing operation of the operating portion 17, the volume of the damper chamber 70 is about to decrease or decreases. Then, the damper torque can be generated by the working pressure in the damper chamber 70, the working pressure being generated when the volume of the damper chamber 70 is about to decrease or decreases. When the working pressure reaches set pressure of the relief valve 71, the valve body 77 of the relief valve 71 provided to communicate with the damper chamber 70 opens, and the damper torque corresponding to the flow rate of the oil flowing through the relief valve 71 is generated.

Therefore, even when the operation speed (swing speed) of the operating portion 17 is any operation speed, such as 0 (zero), the damper portion 68 can effectively generate the resistance force with respect to the operation of the operating portion 17 and prevent the oscillations and vibrations of the operating portion 17, the oscillations and vibrations being not intended by the operator.

The damper portion 68 shown in FIG. 7 can generate desired damper torque by setting the relief valve 71 of the damper portion 68 such that the relief valve 71 has a desired override characteristic. Examples of a method of setting the relief valve 71 such that the relief valve 71 has the desired override characteristic are to change the shape of the valve body 77 of the relief valve 71 and to change the spring constant of the relief spring 78 configured to press the valve body 77 against the valve seat 75.

Moreover, in the relief valve 71 shown in FIG. 7, the opening 80 communicating with the back pressure chamber 79 is formed as a restrictor. Therefore, the damper portion 68 can generate the damper torque corresponding to the operation speed of the operating portion 17. With this, even if a drastic operation force is applied to the operating portion 17, the operation speed of the operating portion 17 can be reduced.

Next, Embodiment 2 of the operating device according to the present invention will be explained in reference to FIGS. 8 and 9. A difference between an operating device 85 according to Embodiment 2 shown in FIGS. 8 and 9 and the operating device 67 according to Embodiment 1 shown in FIGS. 6 and 7 is that a damper portion 86 is different from the damper portion 68.

Figure 8B:
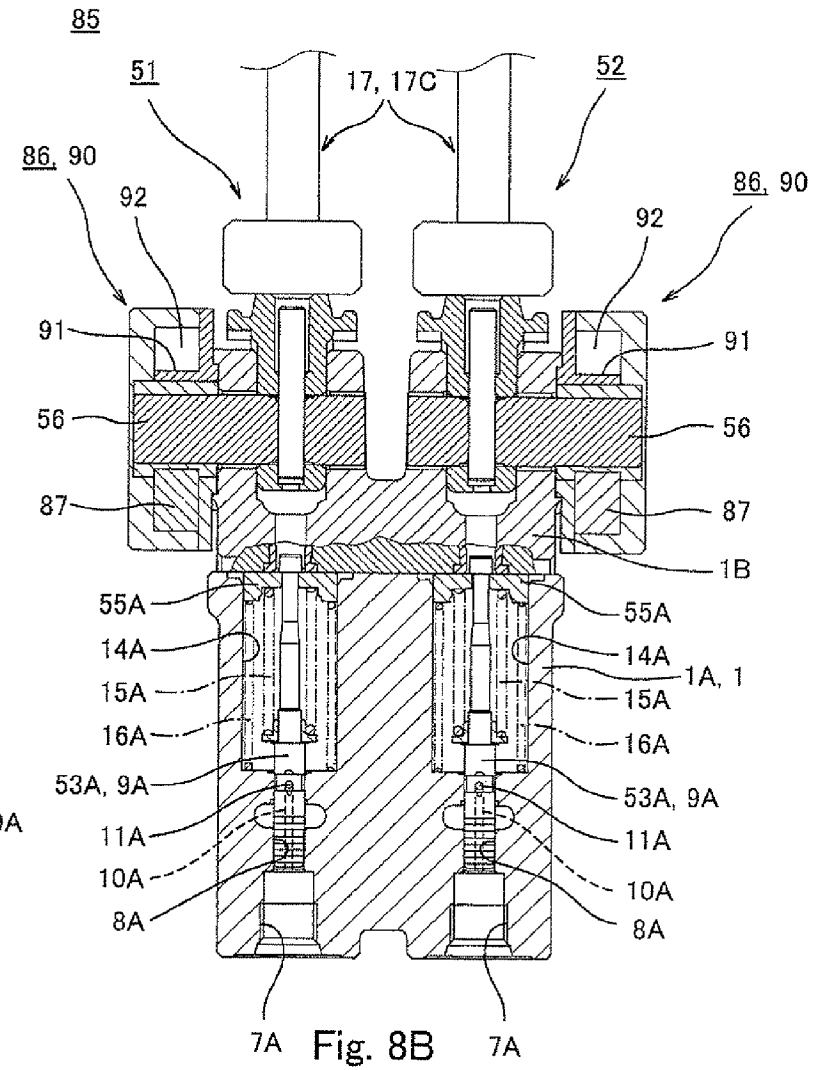
FIGS. 8A and 8B are diagrams each showing the operating device according to Embodiment 2 of the present invention.
Figure 8A:
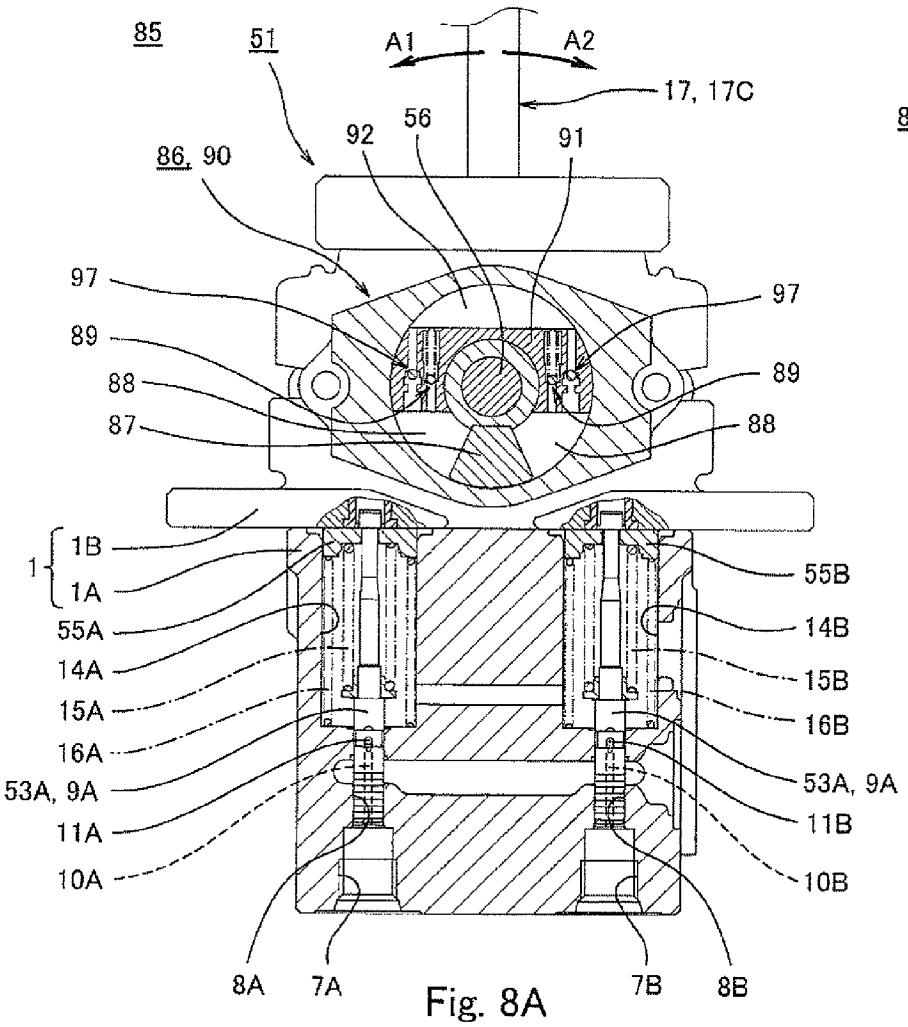
Figure 9:
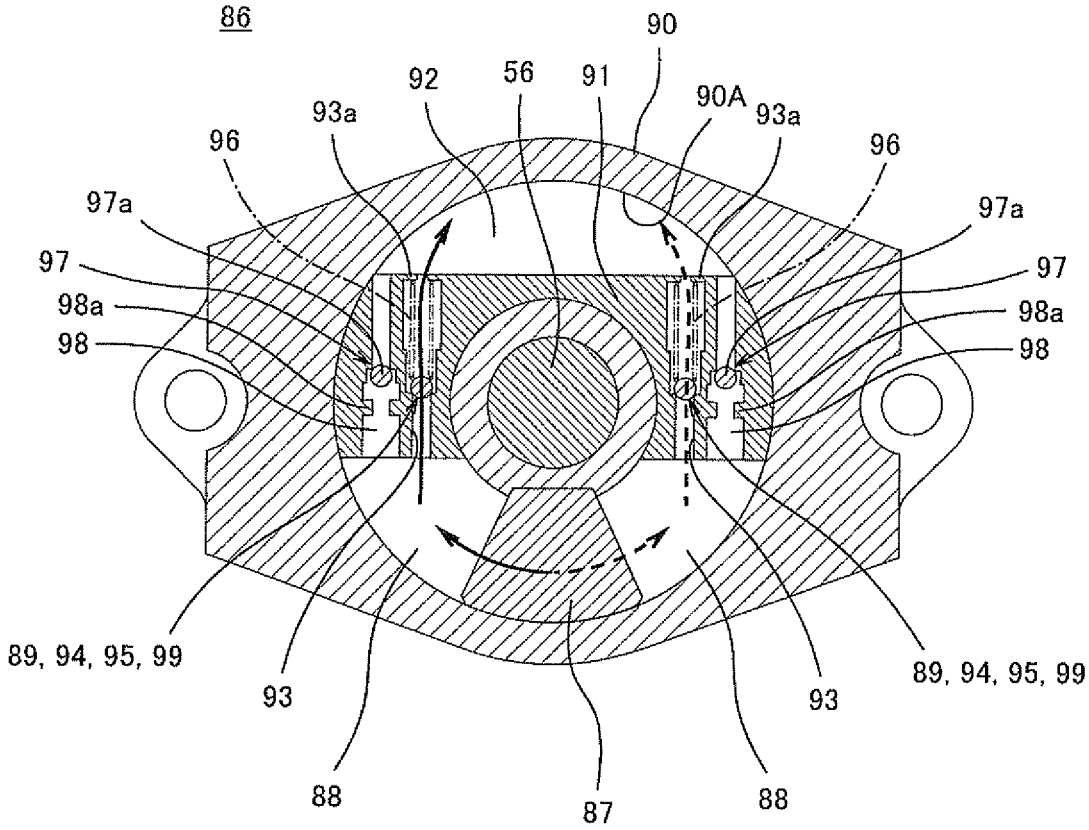
FIG. 9 is an enlarged cross-sectional view showing the damper portion included in the operating device according to Embodiment 2 of the present invention.

The damper portion 86 of Embodiment 2 shown in FIGS. 8 and 9 and the damper portion 68 of Embodiment 1 shown in FIGS. 6 and 7 are different from each other in that: the damper portion 68 of Embodiment 1 shown in FIGS. 6 and 7 is configured such that the movable member 69 moves in the straight direction by the swing operation of the operating portion 17; and the damper portion 86 of Embodiment 2 shown in FIGS. 8 and 9 is configured such that a movable member 87 swings in a circular-arc direction by the swing operation of the operating portion 17.

Left and right damper portions 86 shown in FIG. 8B are the same as each other. As shown in, for example, FIG. 9, each of the damper portions 86 is provided with the movable member 87 configured to increase or decrease the volume of a left or right damper chamber 88 and be movable in the circular-arc direction. When the movable member 87 moves in the circular-arc direction in accordance with the swing operation of the operating portion 17, the volume of the left (or right) damper chamber 88 is decreased. By the working pressure generated by the decrease in the volume of the damper chamber 88, a relief valve 89 communicating with the damper chamber 88 opens, and this working pressure can generate the damper torque.

As shown in FIG. 9, the damper portion 86 includes a damper case 90 having an inner space 90A formed in a substantially cylindrical shape centered around the rocker shaft 56. The damper case 90 is fixedly attached to the casing 1, and a fixed member 91 is fixedly attached to the damper case 90. The fixed member 91 divides the inner space 90A of the damper case 90 into the left and right damper chambers 88 and a back pressure chamber 92.

As shown in FIG. 9, the movable member 87 is fixedly provided at the rocker shaft 56 and swings in accordance with the rocker shaft 56. The movable member 87 is provided so as to form two damper chambers 88, and a tip end portion of the movable member 87 slidably contacts an inner peripheral surface forming the inner space 90A of the damper case 90.

Further, as shown in FIG. 9, the relief valve 89 and a check valve 97 are provided at each of left and right side portions of the fixed member 91.

The relief valve 89 includes a communication hole 93 formed on the fixed member 91, and the communication hole 93 causes the damper chamber 88 and the back pressure chamber 92 to communicate with each other. A valve seat 94 is formed at the communication hole 93, and a valve body 99 is provided so as to close a valve hole 95 formed at the valve seat 94. The valve body 99 is biased by a relief spring 96 (pressing spring) in a direction toward the valve seat 94. The relief spring 96 is provided in the communication hole 93, and the spring force thereof prevents the hydraulic oil in the damper chamber 88 from flowing into the back pressure chamber 92 through the communication hole 93.

As shown in FIG. 9, a convex portion 93*a* configured to prevent the relief spring 96 from coming out is formed as, for example, a circular convex portion at an opening of the communication hole 93, the opening being located on the back pressure chamber 92 side.

The check valve 97 includes a communication hole 98 formed on the fixed member 91, and the communication hole 98 causes the damper chamber 88 and the back pressure chamber 92 to communicate with each other. The check valve 97 can allow the oil in the back pressure chamber 92 to flow into the damper chamber 88 through the communication hole 98 but is provided to prevent the oil in the damper chamber 88 from flowing into the back pressure chamber 92 through the communication hole 98.

As shown in FIG. 9, a convex portion 98*a* configured to prevent a valve body 97*a* having, for example, a spherical shape from coming out is formed on an inner peripheral surface of an opening of the communication hole 98, the opening being located on the damper chamber 88 side. An inner peripheral shape of the convex portion 98*a* is such that the valve body 97*a* does not close the communication hole 98. Examples of the inner peripheral shape of the convex portion 98*a* are noncircles, such as substantially oval shapes and substantially quadrangular shapes.

According to the operating device 85 shown in FIGS. 8 and 9, when the operator starts causing the operating portion 17 to swing or when the operator is causing the operating portion 17 to swing, the damper portion 86 can generate the resistance force as with Reference Technical Example 1.

According to the damper portion 86, when the movable member 87 is about to swing or swings in accordance with the swing operation of the operating portion 17, the volume of one of the damper chambers 88 is about to decrease or decreases. Then, the damper torque can be generated by the working pressure in the damper chamber 88, the working pressure being generated when the volume of the damper chamber 88 is about to decrease or decreases. When the working pressure reaches set pressure of the relief valve 89, the valve body 99 of the relief valve 89 provided to communicate with the damper chamber 88 opens against the spring force of the relief spring 96, and the damper torque corresponding to the flow rate of the oil flowing through the relief valve 89 is generated.

Therefore, even when the operation speed (swing speed) of the operating portion 17 is any operation speed, such as 0 (zero), the damper portion 86 can effectively generate the resistance force with respect to the operation of the operating portion 17 and prevent the oscillations and vibrations of the operating portion 17, the oscillations and vibrations being not intended by the operator.

As with the damper portion 68 of Embodiment 1 shown in FIG. 7, the damper portion 86 of Embodiment 2 shown in FIG. 9 can generate the desired damper torque by setting the relief valve 89 of the damper portion 86 such that the relief valve 89 has the desired override characteristic.

As with the relief valve 71 shown in FIG. 7, in the relief valve 89 shown in FIG. 9, the opening of the communication hole 93 is formed as a restrictor, the opening communicating with the back pressure chamber 92. With this, the damper torque corresponding to the operation speed of the operating portion 17 can be generated.

Next, Reference Technical Example 3 related to the operating device according to the present invention will be explained in reference to FIG. 10. A difference between an operating device 116 according to Reference Technical Example 3 shown in FIG. 10 and the operating device 50 according to Reference Technical Example 1 shown in FIGS.

1 and 2 is that a damper portion 117 capable of generating the resistance force with respect to the swing operation of the operating portion 17 when the operator causes the operating portion 17 to swing in the direction A1 or A2 is different from the damper portion 54. Other than the above, Reference Technical Example 3 is the same as Reference Technical Example 1. Therefore, the same reference signs are used for the same components, and detailed explanations thereof are omitted.

Figure 10B:
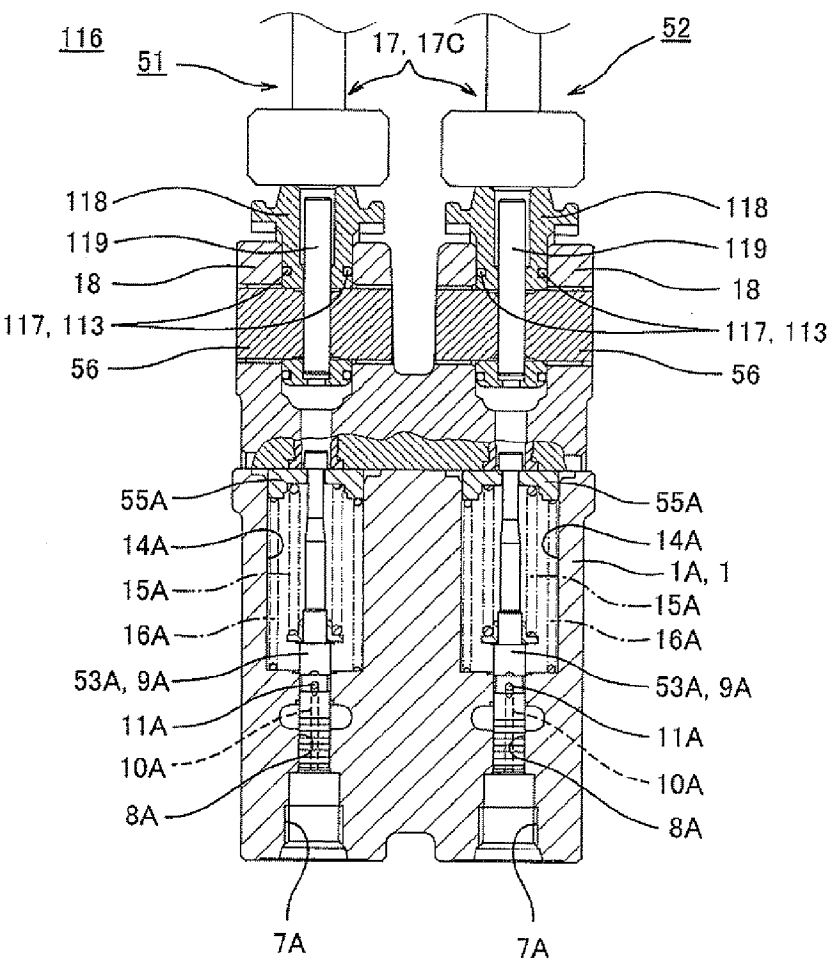
FIGS. 10A and 10B are diagrams each showing the operating device according to Reference Technical Example 3 related to the present invention.

A pair of left damper portions 117 and a pair of right damper portions 117 shown in FIG. 10B are the same as each other. The damper portions 117 are configured such that one or a plurality of elastic friction members 113 each made of a rubber-like elastic body are provided between a left outer surface (swing surface) of a cam portion 118 constituting the operating portion 17 and a left inner surface (fixed surface) of the bracket 18 sandwiching the cam portion 118 from left and right sides and between a right outer surface (swing surface) of the cam portion 118 and a right inner surface (fixed surface) of the bracket 18 so as to be compressed in the axial direction of the rocker shaft 56.

As shown in FIG. 10B, each of the elastic friction members 113 is, for example, an O ring having an annular shape. The elastic friction member 113 is attached to each of circular grooves formed on the outer surface of the cam portion 118.

As shown in FIG. 10B, a coupling pin 119 is attached to and coupled to the cam portion 118. The coupling pin 119 is attached to a through hole formed on the rocker shaft 56 and is coupled to the rocker shaft 56. Thus, an operating lever 17*c* is coupled to the rocker shaft 56.

Herein, the elastic friction member 113 is the O ring. However, instead of this, an annular plate-shaped member made of a rubber-like elastic body may be used as the elastic friction member 113. A plurality of elastic friction members 113 may be provided on the outer surface of the cam portion 118 so as to form multiple circles along the radial direction of the rocker shaft 56.

Figure 10A:
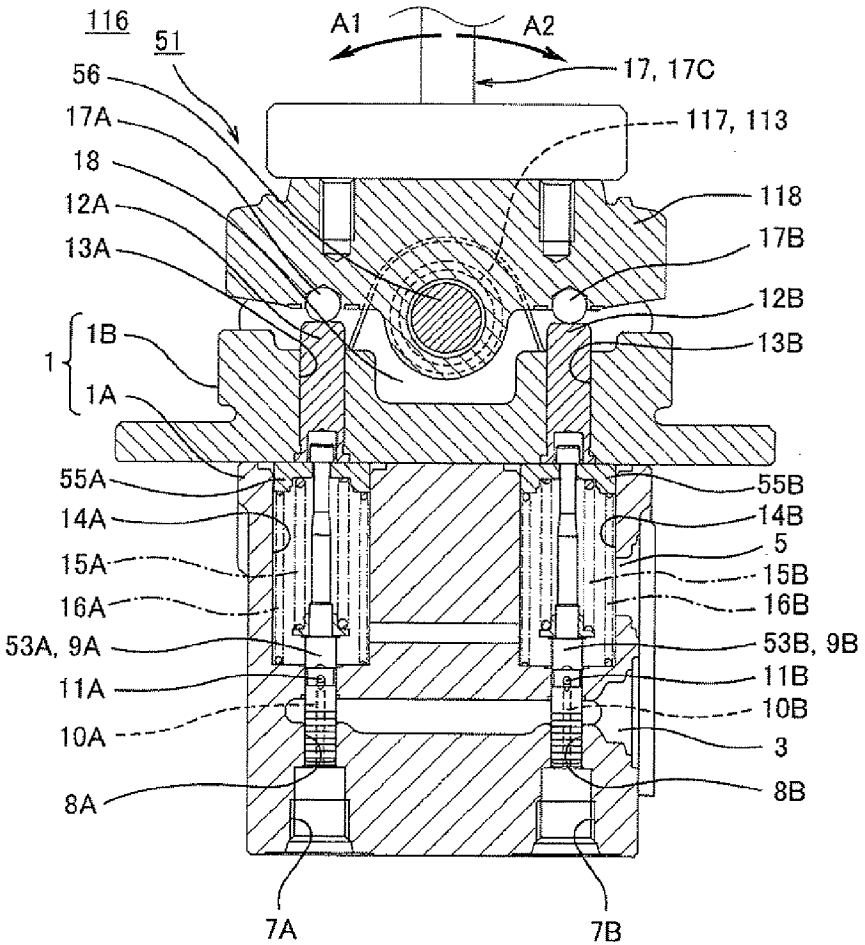

According to the operating device 116 shown in FIG. 10, when the operator starts causing the operating portion 17 to swing or when the operator is causing the operating portion 17 to swing, the damper portion 117 can generate the resistance force as with Reference Technical Example 1.

The damper portion 117 is configured such that the elastic friction member 113 made of the rubber-like elastic body is attached between the outer surface of the cam portion 118 configured to swings as the operating portion 17 and the inner surface of the bracket 18 so as to be compressed. Therefore, even when the operation speed (swing speed) of the operating portion 17 is any operation speed, such as 0 (zero), the damper portion 117 can effectively generate the resistance force with respect to the operation of the operating portion 17, prevent the oscillations and vibrations of the operating portion 17 due to the oscillations and vibrations of machinery, such as construction machinery, and prevent the operation of the operating portion 17 by the operator, the operation being not intended by the operator. In addition, there is no backlash (play) of the operating portion 17 in an operation direction of the operating portion 17 (circumferential direction of the rocker shaft 56), and the damper portion 117 can effectively generate the resistance force in the operation direction when the operation speed of the operating portion 17 is 0.

Next, Reference Technical Example 4 related to the operating device according to the present invention will be explained in reference to FIG. 11. A difference between an operating device 111 according to Reference Technical Example 4 shown in FIG. 11 and the operating device 50 according to Reference Technical Example 1 shown in FIGS. 1 and 2 is that a damper portion 112 capable of generating the resistance force with respect to the swing operation of the operating portion 17 when the operator causes the operating portion 17 to swing in the direction A1 or A2 is different from the damper portion 54. Other than the above, Reference Technical Example 4 is the same as Reference Technical Example 1. Therefore, the same reference signs are used for the same components, and detailed explanations thereof are omitted.

Figure 11:
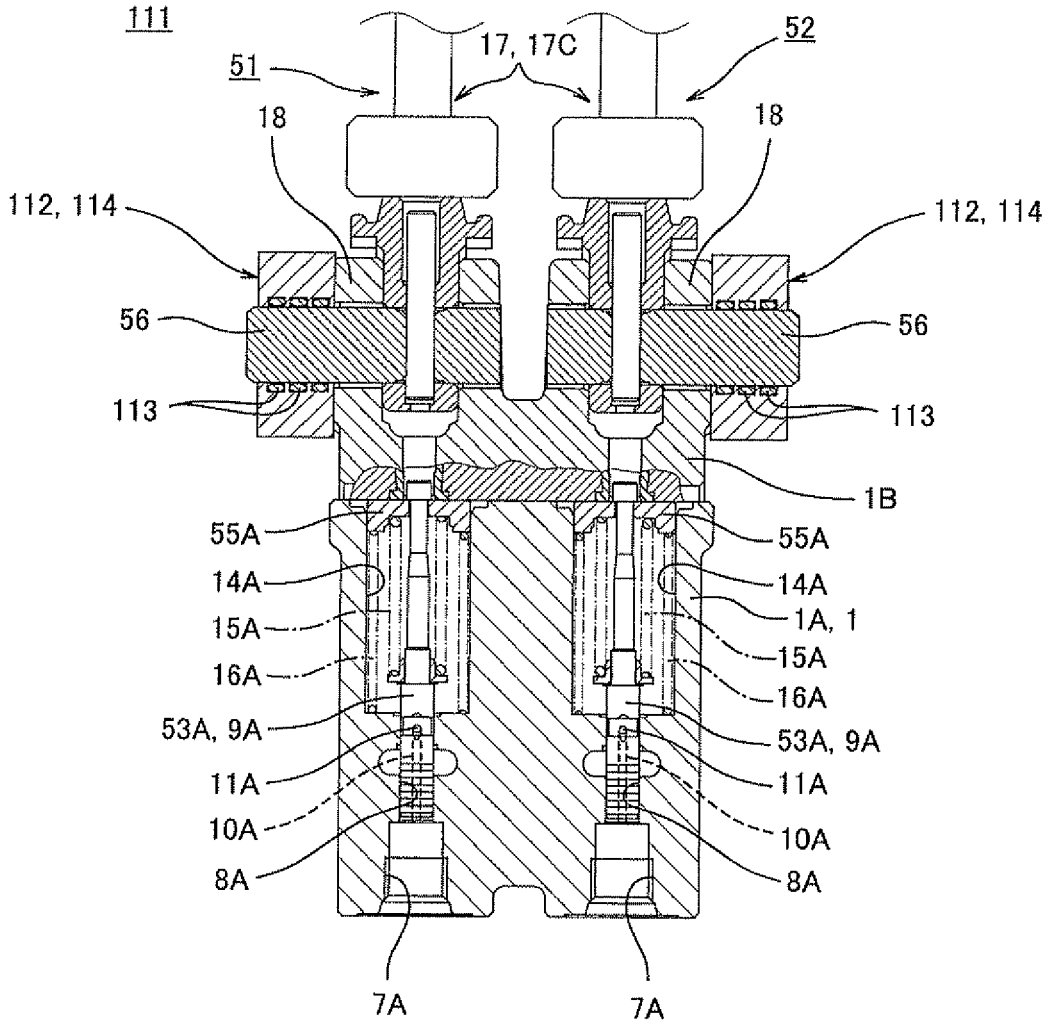
FIG. 11 is a vertical cross-sectional front view showing the operating device according to Reference Technical Example 4 related to the present invention.

Left and right damper portions 112 shown in FIG. 11 are the same as each other. Each of the damper portions 112 is configured such that a plurality of (for example, three) elastic friction members 113 each made of a rubber-like elastic body are attached between a cylindrical outer peripheral surface (swing surface) of the rocker shaft 56 configured to be rotated in accordance with the operating portion 17 and a cylindrical inner peripheral surface (fixed surface) of a damper case 114 so as to be compressed in the radial direction of the rocker shaft 56.

As shown in FIG. 11, each of the elastic friction members 113 is, for example, an O ring having an annular shape. The elastic friction members 113 are provided along the axial direction of the rocker shaft 56 so as to be spaced apart from one another at predetermined intervals. The elastic friction members 113 are respectively attached in a plurality of circular grooves formed on the inner peripheral surface of the damper case 114.

Herein, the elastic friction member 113 is an O ring. However, instead of this, a cylindrical member made of a rubber-like elastic body may be used as the elastic friction member 113.

As shown in FIG. 11, the damper case 114 is formed in a substantially cylindrical shape having predetermined thickness, and an end portion thereof is fixedly attached to the bracket 18.

According to operating device 111 shown in FIG. 11, when the operator starts causing the operating portion 17 to swing or when the operator is causing the operating portion 17 to swing, the damper portion 112 can generate the resistance force as with Reference Technical Example 1.

The damper portion 112 is configured such that a plurality of elastic friction members 113 each made of a rubber-like elastic body are attached between the outer peripheral surface of the rocker shaft 56 configured to swing in accordance with the operating portion 17 and the inner peripheral surface of the damper case 114. Therefore, even when the operation speed (swing speed) of the operating portion 17 is any operation speed, such as 0 (zero), the damper portion 112 can effectively generate the resistance force with respect to the operation of the operating portion 17, prevent the oscillations and vibrations of the operating portion 17 due to the oscillations and vibrations of machinery, such as construction machinery, and prevent the operation of the operating portion 17 by the operator, the operation being not intended by the operator. In addition, there is no backlash (play) of the operating portion 17 in the operation direction of the operating portion 17 (circumferential direction of the rocker shaft 56), and the damper portion 112 can effectively generate the resistance force in the operation direction when the operation speed of the operating portion 17 is 0.

In Embodiments 1 and 2, the operating device according to the present invention is applied to a hydraulic operated valve (pilot valve). However, the present invention is applicable to not only hydraulic operated units, such as pilot valves, configured to output hydraulic signals but also electrically operated units configured to output electric signals.

INDUSTRIAL APPLICABILITY

As above, the operating device according to the present invention can effectively generate the resistance force with respect to the operation of the operating portion even when the operation speed of the operating portion is any operation speed, such as 0 (zero), and has an excellent effect in which the oscillations and vibrations of the operating portion can be prevented, the oscillations and vibrations being not intended by the operator. Thus, the present invention is suitably applied to such an operating device.

REFERENCE SIGNS LIST

1 casing
1A lower casing
1B upper casing
2 hydraulic pump
3 pump port
4 tank
5 tank port
7A, 7B output port
8A, 8B passage
9A, 9B spool
10A, 10B oil passage
11A, 11B oil hole
12A, 12B pusher
13A, 13B insertion hole
14A, 14B spring chamber
15A, 15B balance spring
16A, 16B return spring
17 operating portion
17A, 17B pressing portion
17C lever portion
18 bracket
19 direction switching valve
20A, 20B pipe
21 hydraulic motor
22 main pump
50, 61, 67, 85 operating device
51 left operating device
52 right operating device
53A first pilot valve, third pilot valve
53B second pilot valve, fourth pilot valve
54, 62, 68, 86 damper portion
55A, 55B spring holding portion
56 rocker shaft
57 swing friction plate
58, 63 fixed friction plate
59, 65, 90 damper case
90A inner space
60, 64 pressing spring
69, 87 movable member
70, 88 damper chamber
71, 89 relief valve
73 pressing portion
74 return spring
75 valve seat
76 valve hole
77, 99 valve body
78, 96 relief spring
79, 92 back pressure chamber
80, 82 opening
81 oil passage
83, 97 check valve
91 fixed member
93, 98 communication hole
93*a* convex portion configured to prevent relief spring from coming out
94 valve seat
95 valve hole
97*a* valve body
98*a* convex portion configured to prevent valve body from coming out
111 operating device
112 damper portion
113 elastic friction member
114 damper case
116 operating device
117 damper portion
118 cam portion
119 coupling pin
A1, A2 tilt direction

The invention claimed is:

1. An operating device comprising:

an operating portion provided at a fixed portion so as to be swingable;

a damper chamber;

a relief valve configured to communicate with the damper chamber;

a damper portion configured to generate resistance force in response to a swing operation of the operating portion, and provided with a movable member configured to move in a direction to increase or decrease a volume of the damper chamber, wherein:

when force from the operating portion is applied to the movable member, a working pressure is generated in the damper chamber that: (i) opens the relief valve, and (ii) generates damper torque;

the relief valve includes a back pressure chamber and a valve body located between the damper chamber and the back pressure chamber; and the relief valve includes an opening communicating with the back pressure chamber, and the opening is configured to restrict the relief valve.

2. The operating device according to claim 1, wherein the relief valve is configured to generate desired damper torque by setting the relief valve such that the relief valve has a desired override characteristic.

3. The operating device according to claim 1, wherein a restrictor is formed on a passage of the relief valve, the passage being formed such that a pressure liquid flows therethrough when the relief valve is opened.

4. The operating device according to claim 1, further comprising:

a biasing unit configured to bias the operating portion such that the operating portion returns to a predetermined neutral position set at a position within a swing range of the operating portion, wherein in response to an operation speed of the operating portion being zero, a damper torque generated by the damper portion is not less than 30% of a neutral return torque generated by the biasing unit when the operating portion is at the neutral position and the damper torque is less than the neutral return torque.

5. The operating device according to claim 1, further comprising a hydraulic pilot valve configured to operate by causing the operating portion to swing, wherein:

the pilot valve includes:

a casing having a pump port, a tank port, and an output port, a spool provided in the casing and configured to switch the output port between the pump port and the tank port, and a pusher configured to be caused to slide relative to the spool; and by pressing the pusher by the operating portion to cause the spool to slide, liquid pressure from the pump port is supplied to the output port.

* * * * *